US007891205B2

(12) United States Patent
Cushman

(10) Patent No.: US 7,891,205 B2
(45) Date of Patent: Feb. 22, 2011

(54) REFRIGERATOR DEFROSTING AND CHILLING COMPARTMENT

(75) Inventor: Robert L. Cushman, Sunrise Beach, MO (US)

(73) Assignee: Electrolux Home PRoducts, Inc., Cleveland, OH (US)

( * ) Notice: Subject to any disclaimer, the term of this patent is extended or adjusted under 35 U.S.C. 154(b) by 319 days.

(21) Appl. No.: 11/749,969

(22) Filed: May 17, 2007

(65) Prior Publication Data

US 2008/0282714 A1 Nov. 20, 2008

(51) Int. Cl.
*F25D 21/06* (2006.01)

(52) U.S. Cl. ..... 62/152; 62/80; 62/151; 62/186; 62/187; 62/407

(58) Field of Classification Search ..... 62/80, 62/151, 152, 154, 186, 187, 407
See application file for complete search history.

(56) References Cited

U.S. PATENT DOCUMENTS

| | | | | |
|---|---|---|---|---|
| 3,134,242 | A | 5/1964 | Hanson | |
| 3,747,361 | A | 7/1973 | Harbour | |
| 3,976,122 | A | 8/1976 | Neidhardt | |
| 4,002,199 | A | 1/1977 | Jacobs | |
| 4,326,390 | A | 4/1982 | Brooks | |
| 4,884,626 | A | 12/1989 | Filipowski | |
| 4,913,223 | A | 4/1990 | Mizuno et al. | |
| 5,209,073 | A | 5/1993 | Thomas et al. | |
| 5,326,578 | A | 7/1994 | Yun | |
| 5,930,454 | A | 7/1999 | Cho | |
| 6,405,548 | B1 | 6/2002 | Hollenbeck | |
| 6,612,116 | B2 | 9/2003 | Fu et al. | |
| 6,782,706 | B2 | 8/2004 | Holmes et al. | |
| 6,802,369 | B2 | 10/2004 | Zentner et al. | |
| 2002/0104325 | A1 * | 8/2002 | Mandel et al. | 62/187 |
| 2003/0115892 | A1 * | 6/2003 | Fu et al. | 62/187 |
| 2004/0107726 | A1 * | 6/2004 | Kim et al. | 62/441 |

FOREIGN PATENT DOCUMENTS

JP 20040144365 A 5/2004

OTHER PUBLICATIONS

International Search Report for International Application No. PCT/US2008/062748 dated Sep. 17, 2008, 4 pages.

* cited by examiner

*Primary Examiner*—Judy J. Swann
*Assistant Examiner*—Paolo Gonzalez
(74) *Attorney, Agent, or Firm*—Pearne & Gordon LLP

(57) ABSTRACT

A defrosting and chilling compartment that can be incorporated into the fresh food compartment of a refrigerator includes separate and independent pathways for selectively conducting warming or cooling air, respectively, to a holding section in the compartment where an item to be defrosted or chilled is located. Certain of the pathways are used to conduct warming air and certain other pathways are used to conduct cooling air. A heating device is associated with the pathways that conduct warming air, and the pathways that conduct cooling air are associated with a source of cooling air. Separate air-moving devices, such as fans for example, can be provided for the separate pathways. The pathways can include a closure device for selectively and variably opening and closing the pathways.

16 Claims, 3 Drawing Sheets

FIG. 1
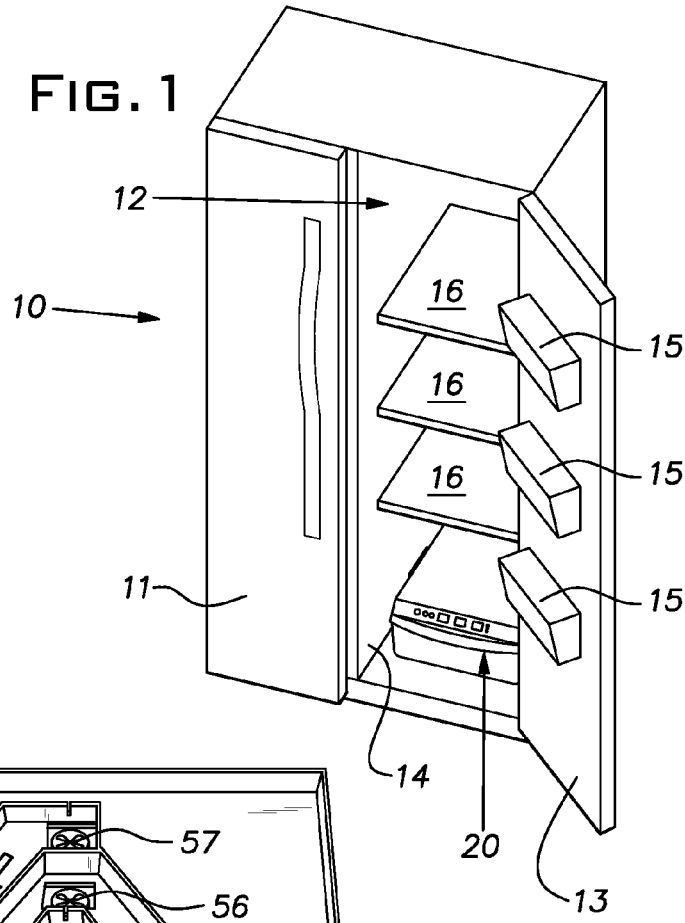
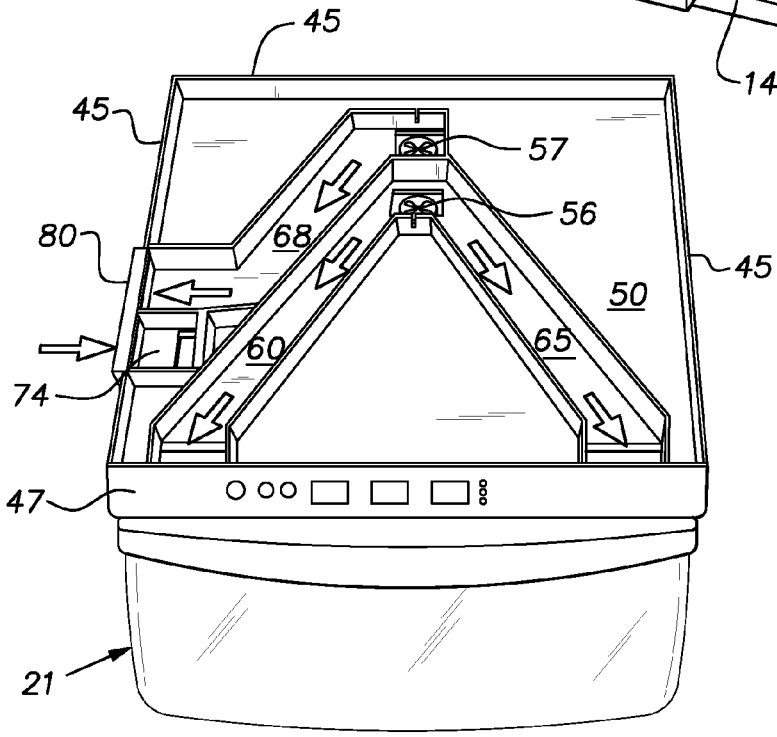
FIG. 3

REFRIGERATOR DEFROSTING AND CHILLING COMPARTMENT

BACKGROUND OF THE INVENTION

This invention relates generally to refrigerators and, more particularly, to defrosting and chilling compartments or units for refrigerators.

A modern household refrigerator typically comprises a freezer storage section, or compartment, and a fresh food storage section, or compartment, that are arranged side-by-side or over and under one another. In the former instance the compartments are separated by a vertical wall or mullion, and in the latter instance the compartments are separated by a horizontal wall or mullion. Usually, shelves and baskets are provided in the freezer section and shelves and drawers are provided in the fresh food section. Auxiliary equipment such as an ice maker, located in the freezer compartment, and/or a water dispenser may also be provided. Suitable doors close off the fronts of the freezer and fresh food compartments and provide access to those compartments.

A complement to conventional household refrigerators that is finding acceptance by consumers is a defrosting and chilling compartment, sometimes referred to as a "defrost and chill compartment" or "quick chill and thaw compartment", that is located in the fresh food section of the refrigerator. The defrosting and chilling compartment, when it is used to defrost food, allows food placed in the compartment to be defrosted more rapidly or less rapidly, depending on the user's needs and wishes, than would be the case if the food were simply placed in the refrigerator's fresh food section or outside the refrigerator at room temperature. In addition, the defrosting and chilling compartment, when it is used to defrost food, addresses health concerns associated with the uncontrolled defrosting of frozen food at room temperature outside the refrigerator. Using a defrosting and chilling compartment allows the frozen food to be thawed under controlled conditions so that the food will be ready to be used when desired. In addition, the use of a defrosting and chilling compartment allows the food, once it is thawed, to be maintained at a temperature, typically the temperature of the fresh food compartment, that will avoid spoilage of the food.

The defrosting and chilling compartment also can be used to quickly and effectively chill foods to temperatures normally maintained in the fresh food compartment of the refrigerator. Thus, it is often the case that there is a need to chill a food or beverage item more rapidly than can be accomplished by placing the item in the fresh food compartment of the refrigerator. As a result, occasionally, the item is placed in the freezer section of the refrigerator in order to rapidly chill the item. However, close attention must be given to the item in order to prevent the item from remaining in the freezer section for a period of time longer than is necessary and oftentimes the fact that the item is in the freezer is forgotten, resulting in freezing of the item with unhappy consequences such as occurs when the cap of a glass beverage container is forced from the container by the freezing liquid in the container.

BRIEF SUMMARY OF THE INVENTION

According to one aspect of the invention, a defrosting and chilling compartment for a refrigerator has separate and independent pathways for separately conducting air to the defrosting and chilling compartment for selectively defrosting or chilling an item of food in the defrosting and chilling compartment. The compartment can include separate air-moving devices such as fans, for example, associated with the separate and independent pathways.

According to another aspect of the present invention, a defrosting and chilling compartment for a refrigerator includes a holding section that is intended to hold an item to be defrosted or chilled. The holding section has a front, a rear, two sides and a top. In a particular aspect, at least one exhaust opening is provided at the rear of the holding section for exhausting air from the holding section. A first air-moving device, such as a fan for example, is provided for selectively moving air to the holding section, and at least one first pathway is provided for conducting the air selectively moved by the first air-moving device to the holding section. A heating device is provided for selectively heating the air moved by the first air-moving device to the holding section along the at least one first pathway. A second air-moving device, such as a fan for example, is provided for selectively moving air to outside the defrosting and chilling compartment, and at least one second pathway is provided for conducting the air selectively moved by the second air-moving device to outside the defrosting and chilling compartment. The at least one second pathway is independent and substantially isolated from the at least one first pathway. At least one third pathway is provided for conducting air between a source of cooling air and the holding section. The at least one third pathway is independent of and substantially isolated from the at least one first pathway.

According to a further aspect, the defrosting and chilling compartment includes two first pathways. In that case, one of the two first pathways can be in fluid communication with the holding section at a location adjacent the top, the front and one of the sides of the holding section and the other of the two first pathways can be in fluid communication with the holding section at a location adjacent the top, the front and the other of the sides of the holding section. Further, the at least one third pathway can be in fluid communication with the holding section adjacent the top and one of the sides of the holding section.

According to yet another aspect, the exterior of the compartment to which air is conducted along the at least one second pathway by the second air-moving device and the source of cooling air are in fluid communication. As a result, the conducting of the air along the at least one second pathway to the exterior of the compartment causes cooling air to be conducted to the holding section along the at least third pathway.

According to still another aspect, each of the at least one second pathway and the at least one third pathway includes a closure device for selectively and variably opening and closing the at least one second pathway and the at least one third pathway, respectively.

According to yet a further aspect, the defrosting and chilling compartment is installed within a refrigerator having a fresh food section and a freezer section. The defrosting and chilling compartment is located in the fresh food section of the refrigerator and the freezer section of the refrigerator comprises the source of cooling air.

According to still a further aspect, the at least one first pathway, the at least one second pathway, the at least one third pathway, the first air-moving device and the second air-moving device are all supported from a common support member that is removable from the defrosting and chilling compartment.

BRIEF DESCRIPTION OF THE DRAWINGS

FIG. 1 is a somewhat schematic presentation of a frontal perspective view of a refrigerator shown with the door for the fresh food section of the refrigerator open for the purpose of illustrating one manner of locating an embodiment of the defrosting and chilling compartment of the invention within the fresh food section.

FIG. 3 is a somewhat schematic presentation of a perspective view from the top of the embodiment of the defrosting and chilling compartment of the invention shown in FIG. 2 with the cover of the compartment removed for the purpose of illustrating certain internal features of the compartment.

DETAILED DESCRIPTION OF AN EMBODIMENT OF THE INVENTION

Figure 2:
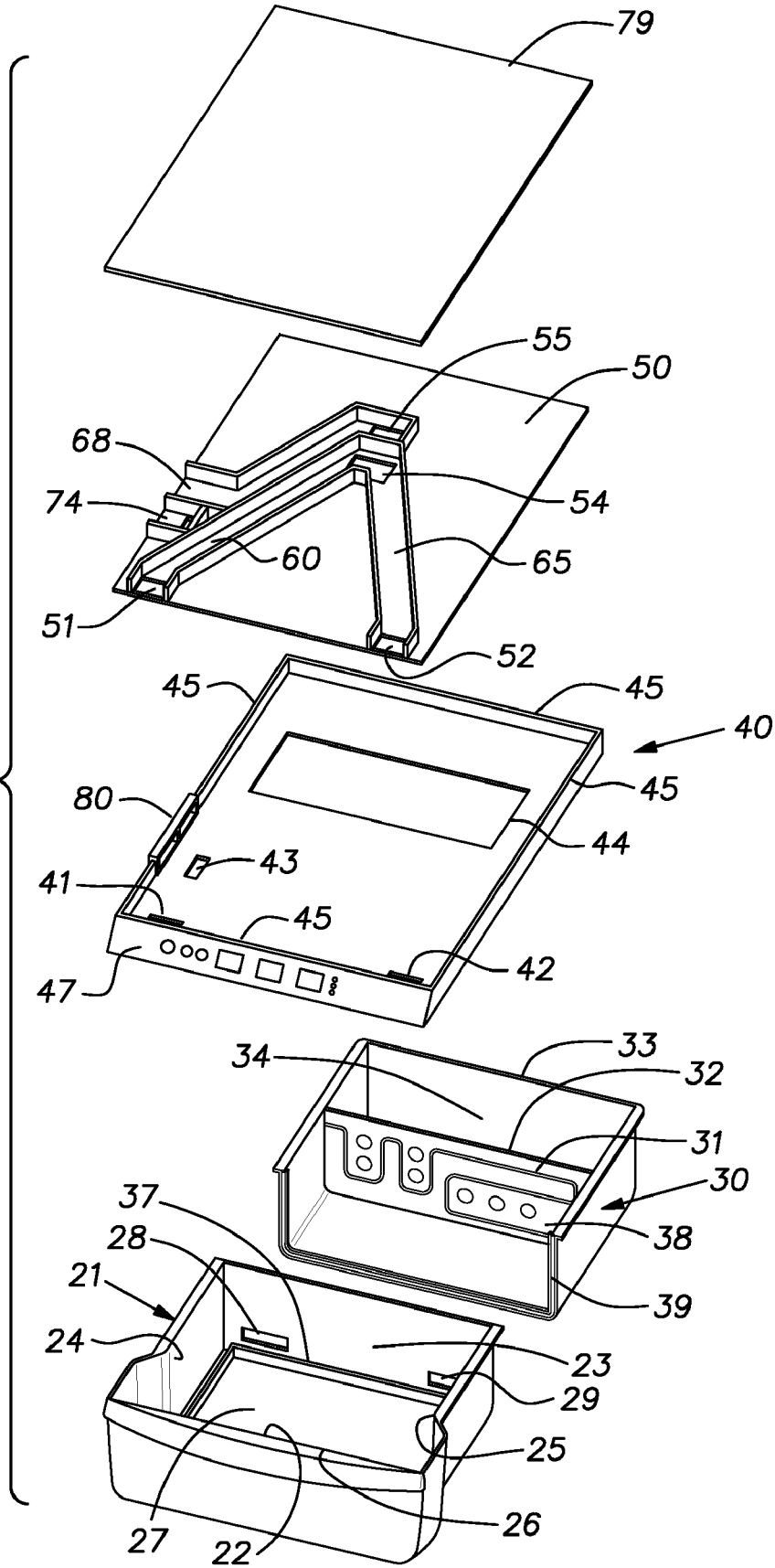
FIG. 2 is a somewhat schematic presentation of an exploded perspective view of an embodiment of the defrosting and chilling compartment of the invention.

Referring first to FIG. 1, a refrigerator of the side-by-side variety is shown generally at 10. The refrigerator includes a freezer section, access to which is had through the door 11 of the freezer section which is shown in FIG. 1 as being closed, and a fresh food section, indicated generally at 12, access to which is had through door 13. The door 13 of the fresh food section 12 is shown as including compartments or shelving 15 that may include a dairy compartment and can be adjusted. Also illustrated in FIG. 1 for exemplary purposes is a plurality of shelves 16 that can be cantilevered from rails mounted to the back of the fresh food compartment as will be understood by those having ordinary skill in the art.

The freezer compartment and the fresh food compartment are separated by a dividing wall or mullion 14 that extends essentially along the full height and width of the interior of the refrigerator. The fresh food section is cooled by air entering the fresh food section from the freezer section through a passageway, not shown, in the mullion 14. Correlatively, air from the fresh food section will flow to the freezer section through an air return, not shown, in the mullion 14. Supplying cold air from the freezer section to the fresh food section and returning air from the fresh food section to the freezer section is known to those having ordinary skill in the art and the details by which such circulation of air is carried out are not presented here except that it is noted that the air from the freezer normally enters the fresh food section through the mullion 14 near the top of the fresh food section, is circulated throughout the fresh food section and then exits the fresh food section and returns to the freezer section through the air return in the mullion 14 near the bottom of the fresh food section. A temperature control device, not shown, can be mounted in the upper area of the fresh food section and be used to regulate the temperatures of both the fresh food and freezer compartments.

Located at the bottom of the fresh food compartment 12 is a defrosting and chilling compartment 20. The defrosting and chilling compartment need not be located as illustrated, however, and can be placed, essentially, anywhere in the fresh food compartment. Additionally, the compartment 20 can comprise one of a stack of compartments, the other compartments being outfitted for other purposes such as for separately holding meats and vegetables for example. Further, although the defrosting and chilling compartment of the invention is illustrated as being located in a side-by-side refrigerator, where the freezer and fresh food sections of the refrigerator are arranged along side one another, the present invention may be applied as well to refrigerators where the freezer section is either above or below the fresh food section and the freezer and fresh food sections are separated by a horizontal dividing wall or mullion. Indeed, the defrosting and chilling compartment of the present invention can be used in environments other than within the fresh food compartment of a refrigerator as will become apparent from the description that follows.

Figure 4:
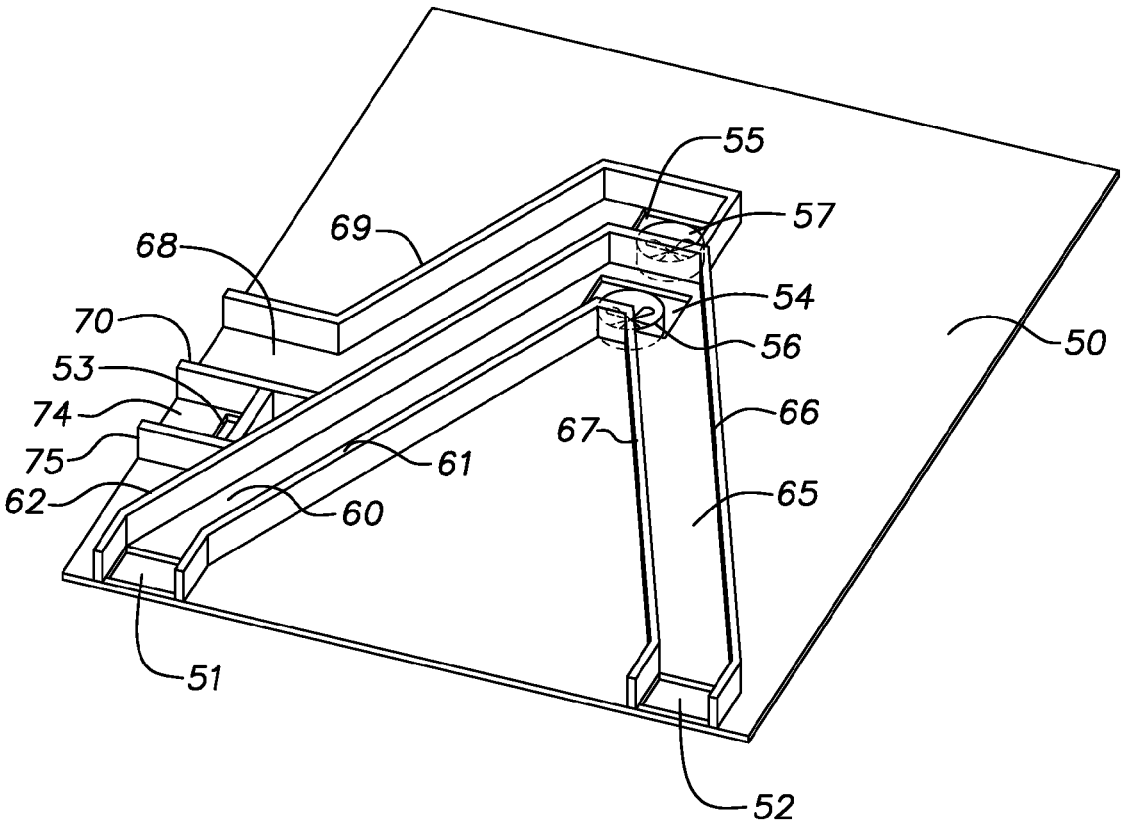
FIG. 4 is a somewhat schematic presentation of a perspective view from the top and a side of a subassembly of the embodiment of the defrosting and chilling compartment shown in FIG. 2.

A detailed description of the embodiment of the defrosting and chilling compartment 20 of the invention can be best understood in connection from a consideration of FIGS. 2, 3 and 4 of the drawings, reference to which will now be made. Referring first to FIG. 2, the defrosting and chilling compartment 20 is shown to include a holding section, indicated generally at 21, that is adapted to be mounted within the fresh food compartment 12 so that it can be moved between a retracted position, as shown in FIG. 1, and an extended position where access may be had to the holding section 21 for the placement of food items to be defrosted or chilled and for the removal of the items after they have been defrosted or chilled.

The holding section 21 includes a front 22, a rear 23, two sides 24 and 25, a top 26 and a bottom 27. At least one exhaust opening is provided in the holding section 21 for exhausting air from the holding section. In the embodiment of the invention shown in the drawings, two exhaust openings 28 and 29 are included. One exhaust opening, the exhaust opening 28, is located adjacent the rear 23, side 24 and bottom 27 of the holding section 21 and the other exhaust opening, the exhaust opening 29, is located adjacent the rear 23, side 25 and bottom 27 of the holding section. A tray 37 can be placed on the bottom 27 of the holding section 21 in which case the items of food to be defrosted or chilled are placed on the tray. Further, the tray can comprise a two piece-assembly of a drip pan base and a perforated deck on which the items sit. The location of the exhaust openings 28 and 29 with relation to the tray 37 is such that air entering the holding section 21 at the front 22 or sides 24 and 25 of the holding section will make good contact with any food item placed on the tray 37 before exiting the holding section through the exhaust openings 28 and 29. Although the holding section 21 in the described embodiment of the invention has a generally rectangular cross-sectional configuration, the holding section may be otherwise configured so as to have, for example, a square or curvilinear cross-sectional configuration.

As indicated above, the holding section 21 is supported in the fresh food section 12 of the refrigerator 10 in any manner familiar to those skilled in the art so that it can be moved out from under the cover member, indicated generally at 40, of the compartment 20 that is secured in place within the fresh food compartment 12. Thereby, access to the holding section 21 may be had for the purpose of placing or removing an item of food in or from the holding section after which the holding section 21 can be returned to a position underneath cover member 40. In the embodiment of the invention shown in the drawings, the holding section 21 is adapted to be slidably mounted within the fresh food compartment 12. Although it is not necessary that the holding section 21 be hermetically sealed by cover member 40 when the holding section 21 is in place underneath cover member 40, it is preferable that enough of a seal exist between holding section 21 and cover member 40 to prevent the easy entry and exiting of air into and out of the holding section.

When it is desired to defrost or thaw an item of food, the holding section 21 is pulled out from under the cover member 40 and the item is placed at the bottom of the holding section 21, such as on the tray 37. The holding section 21 is then returned under the cover member 40 and air of a selected temperature is introduced into the holding section for the purpose of defrosting the item. Similarly, when it is desired to chill an item of food, the item is placed at the bottom of the holding section and air of a selected temperature is introduced into the holding section for the purpose of chilling the item of food.

The defrosting and chilling compartment 20 also comprises a heating and cooling module indicated generally at 30. The module 30 is secured to the cover member 40 and is in abutting engagement with the holding section 21 when the holding section is in place under cover member 40. However, the module 30 and the holding section 21 are separable and the module 30 remains in place underneath the cover 40 when the holding section 21 is pulled out from under the cover member. This is accomplished, for example, by means of a snap fitting arrangement between the module 30 and the cover member 40. A seal 39 is mounted along the front perimeter of the module 30 so that when the holding section 21 is in place beneath the cover member 40 and is in abutting engagement with the holding section 21, the seal 39 will prevent air from passing into or out of the compartment 20 at the juncture of the holding section 21 and the module 30.

The module 30 includes a device for selectively heating air that is introduced into the holding section 21 of the compartment. In the embodiment of the invention illustrated in the drawings, the heating device comprises an adhesive-backed foil heater 31, of the type familiar to those skilled in the art, attached to a mounting plate 32. The mounting plate 32 is supported in the module 30 so as to be spaced away from the rear 23 of the holding section 21, when the holding section and the module 30 engage one another, so as to form a first plenum 38. This arrangement allows air in the plenum 38 to pass over the heater 31 and be heated prior to being conducted to the holding section 21 as further described below. The mounting plate 32 is also located in the module 30 so as to be spaced from the back 33 of the module and create a second plenum 34 in the module 30 from which air can be conducted to the holding section 21 without coming into contact with the heater 31.

As noted above, the cover 40 of the defrosting and chilling compartment, in the embodiment of the invention shown in the drawings, is secured to the interior of the fresh food compartment 12 of the refrigerator 10 and the holding section 21 is slidably supported by means familiar to those having ordinary skill in the art so that the holding section may be opened by pulling the holding section out from under the cover 40 and closed by pushing the holding section back under the cover.

When the holding section 21 is in place under the cover 40, an opening 41 in the cover 40 provides fluid communication, such as the passage of air, to the holding section 21 at a location adjacent the top 26, the front 22 and the side 24 of the holding section, and an opening 42 provides fluid communication, such as the passage of air, to the holding section 21 at a location adjacent the top 26, the front 22 and the other side 25 of the holding section. Also, when the holding section 21 is in place underneath the cover 40, an opening 43 in the cover 40 provides fluid communication, such as the passage of air, to the holding section 21 adjacent the top 26 and the side 24 of the holding section. In the embodiment of the invention shown in the drawings, the opening 43 is also located so as to be approximately midway between the front 22 and the rear 23 of the holding section 21. An additional opening 44 is provided in cover 40 at a location such that when the holding section 21 is in place under the cover 40, both the plenum 38 and the plenum 34 are positioned at least in part below the opening 44 so that air can pass through the opening 44 from each of plenum 38 and plenum 34.

As seen in FIGS. 2 and 3, the compartment 20 further includes a support member in the form of a panel 50 that is adapted to lie in place on cover 40 within the upturned edges 45 of the cover. The panel 50 includes openings 51, 52, 53, 54 and 55. When the panel 50 is secured to cover 40: the opening 51 is in fluid communication with the opening 41 in the cover 40; the opening 52 is in fluid communication with the opening 42 in the cover 40; the opening 53 is in fluid communication with the opening 43 in the cover 40; the opening 54 is in fluid communication with the plenum 38; and the opening 55 is in fluid communication with the plenum 34. As used herein, the phrase "fluid communication" means that locations that are said to be in fluid communication with one another can have a fluid, such as air, pass between the locations.

Mounted to the underside of the panel 50 below the opening 54 is a first air-moving device 56 for selectively moving air to the holding section 21 from plenum 38, as further described below. A second air-moving device 57 is located below the opening 55 in the panel 50 for selectively moving air to outside the defrosting and chilling compartment 20 from plenum 34, also as further described below. In the embodiment of the invention shown in the drawings both air-moving devices comprise fans that are secured to the panel 50 such as by brackets not shown.

At least one first pathway is provided in compartment 12 for conducting the air selectively moved by the first air-moving device 56. In the embodiment of the invention shown in the drawings two such pathways are provided. Referring to FIGS. 2, 3 and 4, the two pathways are established by upstanding pathway walls or vanes that are supported from panel 50. Specifically, one first pathway 60 is defined by the vanes 61 and 62 for conducting to the holding section 21 the air selectively moved by the fan 56 from the plenum 38 and out through the opening 54, the one first pathway 60 being in fluid communication with the holding section 21 through the opening 51 in the panel 50 and the opening 41 in the cover 40. The one first pathway 60 and the holding section 21 are in fluid communication at a location adjacent the top 26, the front 22 and the side 24 of the holding section. In addition, in the embodiment of the invention shown in the drawings, a second or other first pathway 65 is defined by the upstanding walls or vanes 66 and 67 for conducting to the holding section 21 the air selectively moved by the fan 56 from the plenum 38 and out through the opening 54, the other first pathway 65 being in fluid communication with the holding section 21 through the opening 52 in the panel 50 and the opening 42 in the cover 40. The other first pathway 65 and the holding section 21 are in fluid communication at a location adjacent the top 26, the front 22 and the other side 25 of the holding section. As indicated above, air selectively moved by the fan 56 from the plenum 38 and out through the opening 54 will have first passed over the heating device 31 so that the heating device can selectively heat the air moved by the fan 56 to the holding section 21 along the pathways 60 and 65.

At least one second pathway is provided for conducting the air selectively moved by the fan 57 to outside the defrosting and chilling compartment 20. Specifically, a second pathway 68 is defined by the upstanding walls or vanes 62, 69 and 70 for conducting air selectively moved by the fan 57 from the plenum 34 and out through opening 55 to outside the compartment 20. As shown in the drawings, the second pathway 68 is independent and substantially isolated from the one first pathway 60 and the other first pathway 65. In the embodiment of the invention shown in the drawings, the air conducted along the second pathway 68 is exhausted from the second pathway to the fresh food compartment 12 of the refrigerator 10. From that point, the exhausted air will merge with the general air stream that circulates in the fresh food compartment and will pass to the freezer through the freezer air return.

At least one third pathway is provided for conducting air between a source of cooling air and the holding section 21. Specifically, a third pathway 74 is defined by the upstanding walls or vanes 70 and 75 for conducting air from a source of cooling air to the holding section 21, the third pathway 74 being independent of and substantially isolated from the first pathways 60 and 65. The third pathway 74 can be open to the interior of the fresh food compartment or to the freezer section of the refrigerator 10. In the latter instance, an opening in the mullion 14 is provided opposite the third pathway 74 so as to provide fluid communication between the freezer compartment and the third pathway. A suitable means is provided for placing the third pathway 74 and the opening in the mullion in communication without the cold air from the freezer section spilling into the fresh food compartment 12. The opening 43 in the cover 40 and the opening 53 in the panel 50 provide the means by which the third pathway 74 is in fluid communication with the holding section 21 adjacent the top 26 and the one side 24 of the holding section.

The foregoing description of the invention makes reference to various openings in the several components of the compartment 20 for the passage of air therethrough. If a more directed stream of air is desired than would occur with simple openings as shown in the embodiment of the invention shown in the drawings, the openings can be formed with nozzles having apertures of a desired configuration.

The defrosting and chilling compartment 20 also includes a closure panel 79. The perimeter of the closure panel 79 forms the outer bounds of the top of the compartment 20 and the closure panel rests on the top edges of the plurality of vanes that are mounted on panel 50 so as to define one of the boundaries of each of the pathways 60, 65, 68 and 74. The closure panel 79 can be attached to the remainder of the compartment 20 by any suitable means including by gluing the closure panel to the top edges of the vanes.

There will be occasions when it will be desirable to control the air flow capacity of air flow pathways 68 and 74. For that purpose, the embodiment of the invention shown in the drawings is provided with air flow control means 80. In an exemplary case, the air flow control means can comprise adjustable dampers. The use of adjustable dampers to selectively and variably control the air flow capacity of air flow pathways in the refrigerator art is well known. By way of example, electronically controlled sliding dampers can be used and the dampers can function so as to open and close the air flow pathways 68 and 74 in equal proportions at the same time.

Based on the foregoing description, it will be apparent to those having ordinary skill in the art that the present invention can be used in a variety of ways to carry out defrosting and chilling functions on food items placed in holding section 21 of compartment 20. For example, in connection with the defrosting of a food item, a timing mechanism can be provided for controlling the flow of electricity to the heater 31 and the fan 56; and suitable means for setting the timing mechanism so that it will simultaneously start the heater and the fan can be located at the front 47 of the cover 40. In such a mode, the user, based on personal experience or instructions provided by the manufacturer, will set the timing mechanism for an appropriate period of time, given the size of the food item to be defrosted, such that when the timing mechanism has run for the period of time set by the user and turns off the flow of electricity to the heater 31 and the fan 56, the food item will have been defrosted and can safely remain in the fresh food compartment 12 until it is ready to be used. While the timing mechanism is on and the fan 56 is running, air propelled by the fan 56 will be directed along the pathways 60 and 65, as shown by the arrows in FIG. 3, through openings 51 and 52, respectively, in the panel 50, through the openings 41 and 42, respectively, in the cover 40 downwardly into the holding section 21 where the air will pass over the food item in the holding section. The air, after passing over the food item, will exit the holding section 21 through openings 28 and 29 and enter plenum 38 where the air will be warmed and recirculated to the holding section 21 as described.

Similarly, in connection with the rapid cooling of a food item, a timing mechanism can be provided for controlling the flow of electricity to a device for opening and closing each of the dampers 80 and the fan 57. Once again suitable means for setting the timing mechanism can be provided at the front 47 of the cover 40 so that the timing mechanism will energize the device for opening the dampers and start the fan 57. Once more, the user, based on personal experience or instructions from the manufacturer will set the timing mechanism for an appropriate period of time, given the size of the food item to be chilled, such that when the timing mechanism has run for the period of time set by the user and turns off the flow of electricity to the device for opening and closing the dampers, so as to close the dampers, and the fan 56 so as to shut off the fan, the food item will have been chilled to a desired temperature. When the dampers 80 are open and the fan 57 is running air will be propelled by the fan 57 and will be directed along the pathway 68 as shown by the arrows in FIG. 3. where the air will be exhausted from the compartment 20 to the fresh food compartment 12. As a result, the pressure in the compartment 20 will be lowered causing air from either the fresh food compartment or the freezer section to enter the compartment 20 along the pathway 74 as shown by the arrow in FIG. 3. The cold air will then pass through the opening 53 in the panel 50 and the opening 43 in the cover 40 and enter the holding section 21. As more cold air enters the holding section 21 as fan 57 continues to exhaust air from the compartment 21 along pathway 68, air that has passed over the food item to be chilled will exit the holding section 21 through openings 28 and 29. The air that exits the holding section 21 will pass over the top of mounting plate 32 which is configured so as to be slightly below cover 40 and the air will be propelled by fan 57 along air passageway 68 so as to continue the circulation of cold air through the holding section 21.

The electrical energy required for the functioning of the heater 31, the fans 56 and 57, the dampers 80 and any timing mechanisms or other control elements that are operated from the front 47 of the cover member 40 can be provided, for example, by means of electrical wiring that extends between these components and wiring harnesses that run to the refrigerator wiring system.

The foregoing examples of the use of the present invention represent, perhaps, the more basic applications of the invention. However, it will be understood to those having ordinary skill in the art that the present invention can also be used in more complex defrosting and chilling modes. For example, temperature sensors can be located in one or more of the various air flowpaths and/or the holding section 21 with the output of the sensors connected to an electronic controller.

The electronic controller can be coupled to the heater 31, the fans 56 and 57 and the dampers 80 and configured so as to adjust the operation of these components to produce air streams of different flow rates and temperatures in accordance with the particular nature of the defrosting or chilling mode that is desired. In this connection, algorithms for defrosting or chilling can be executed by the electronic controller in response to the temperature information delivered to the controller by the temperature responsive devices so the electronic controller can appropriately adjust the heater the fans and the dampers.

What is claimed is:

1. A defrosting and chilling compartment for a refrigerator that includes a source of cooling air comprising: a holding section, including an interior and an exterior, for holding an article to be selectively defrosted or chilled and a heating and cooling module including a first plenum and a second plenum in fluid communication with the holding section, the first plenum comprising a source of heated air; at least one first pathway extending from the first plenum of the heating and cooling module to the interior of the holding section for selectively conducting heated air to the holding section from the first plenum of the heating and cooling module; at least one second pathway in fluid communication with the interior of the holding section through the second plenum of the heating and cooling module and extending to the exterior of the holding section for conducting air only from the holding section to the exterior of the defrosting and chilling compartment, the at least one second pathway being fluidly independent of and isolated from the at least one first pathway; and at least one third pathway extending from the source of cooling air to the interior of the holding section for conducting air only from the source of cooling air to the interior of the holding section, the at least one third pathway being fluidly independent of and isolated from both the at least one first pathway and the at least one second pathway.

2. The defrosting and chilling compartment of claim 1, including a first air-moving device located at the first plenum of the heating and cooling module for selectively moving air to and from the holding section along the at least one first pathway and a second air-moving device located at the second plenum of the heating and cooling module for selectively moving air to the exterior of the defrosting and chilling compartment along the at least one second pathway.

3. The defrosting and chilling compartment of claim 2 wherein the compartment includes two first pathways.

4. The defrosting and chilling compartment of claim 2 wherein the first air-moving device and the second air-moving device each comprises a fan.

5. The defrosting and chilling compartment of claim including a cover member covering the defrosting and chilling compartment wherein the at least one first pathway is in fluid communication with the first plenum of the heating and cooling module and the interior of the holding section through openings in the cover member, the at least one second pathway is in fluid communication with the second plenum of the heating and cooling module through an opening in the cover member and the at least one third pathway is in fluid communication with the holding section through an opening in the cover member.

6. The defrosting and chilling compartment of claim 1 wherein the exterior of the defrosting and chilling compartment to which air is conducted along the at least one second pathway and the source of cooling air are in fluid communication whereby the conducting of the air along the at least one second pathway to the exterior of the defrosting and chilling compartment causes cooling air to be conducted to the holding section along the at least third pathway.

7. The defrosting and chilling compartment of claim 6 wherein each of the at least one second pathway and the at least one third pathway includes a closure device for selectively and variably opening and closing the at least one second pathway and the at least one third pathway, respectively.

8. A defrosting and chilling compartment for a refrigerator including a fresh food compartment and a source of cooling air, the defrosting and chilling compartment comprising: a holding section, including an interior and an exterior, for holding an article to be selectively defrosted or chilled and a heating and cooling module including a first plenum and a second plenum in fluid communication with the holding section, the first plenum comprising a source of heated air; at least one first pathway extending from the first plenum of the heating and cooling module to the interior of the holding section for selectively conducting heated air to the holding section from the first plenum of the heating and cooling module; at least one second pathway in fluid communication with the interior of the holding section through the second plenum of the heating and cooling module and extending to the fresh food compartment of the refrigerator for conducting air only from the holding section to the fresh food compartment of the refrigerator, the at least one second pathway being fluidly independent of and isolated from the at least one first pathway; and at least one third pathway extending from the source of cooling air to the interior of the holding section for conducting air only from the source of cooling air to the interior of the holding section, the at least one third pathway being fluidly independent of and isolated from both the at least one first pathway and the at least one second pathway.

9. The defrosting and chilling compartment of claim 8, including a first air-moving device located at the first plenum of the heating and cooling module for selectively moving air to and from the holding section along the at least one first pathway and a second air-moving device located at the second plenum of the heating and cooling module for selectively moving air to the fresh food compartment of the refrigerator along the at least one second pathway.

10. The defrosting and chilling compartment of claim 8 wherein each of the at least one second pathway and the at least one third pathway includes a closure device for selectively and variably opening and closing the at least one second pathway and the at least one third pathway, respectively.

11. The defrosting and chilling compartment of claim 8 wherein the at least one first pathway, the at least one second pathway, the at least one third pathway, the first air-moving device and the second air-moving device are all supported from a common support member that is removable from the defrosting and chilling compartment.

12. The defrosting and chilling compartment of claim 5 including a panel adapted to lie in place on the cover member, each of the at least one first pathway, the at least one second pathway and the at least one third pathway being supported from the panel.

13. The defrosting and chilling compartment of claim 12 wherein the panel includes: openings in fluid communication with the openings in the cover member through which the at least one first pathway is in fluid communication with the first plenum of the heating and cooling module and the interior of the holding section; an opening in fluid communication with the opening in the cover member through which the at least one second pathway is in fluid communication with the second plenum of the heating and cooling module; and an opening in fluid communication with the opening in the cover member through which the at least one third pathway is in fluid communication with the holding section.

14. The defrosting and chilling compartment of claim 13 including a first air-moving device located at the first plenum of the heating and cooling module for selectively moving air to and from the holding section along the at least one first pathway and a second air-moving device located at the second plenum of the heating and cooling module for selectively moving air to the exterior of the defrosting and chilling compartment along the at least one second pathway.

15. The defrosting and chilling compartment of claim 14 wherein the first air-moving device and the second air-moving device each comprises a fan.

16. The defrosting and chilling compartment of claim 15 wherein the fans are supported from the panel.

* * * * *